US006209176B1

(12) United States Patent
Anscher

(10) Patent No.: US 6,209,176 B1
(45) Date of Patent: Apr. 3, 2001

(54) ZIPPER PULL CORD FASTENER

(75) Inventor: Joseph Anscher, Muttontown, NY (US)

(73) Assignee: National Molding Corporation, Farmingdale, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/962,744

(22) Filed: Nov. 3, 1997

(51) Int. Cl.[7] ..... A44B 19/00
(52) U.S. Cl. ..... 24/429; 24/421; 24/430
(58) Field of Search ..... 24/429, 430, 431, 24/421, 419; 294/3.6; 2/421

(56) References Cited

U.S. PATENT DOCUMENTS

| | | | | |
|---|---|---|---|---|
| 1,921,286 | * | 8/1933 | Erickson | 24/134 R |
| 3,641,634 | * | 2/1972 | Asai | 24/429 |
| 3,852,943 | * | 12/1974 | Healy | 24/134 R |
| 4,373,234 | * | 2/1983 | Boden | 24/134 R |
| 4,424,609 | * | 1/1984 | Boden | 24/134 R |
| 4,639,978 | * | 2/1987 | Boden | 24/134 R |
| 4,716,630 | * | 1/1988 | Skyba | 24/134 R |
| 4,790,050 | * | 12/1988 | Ishii | 24/429 |
| 5,283,930 | * | 2/1994 | Krauss | 24/130 |
| 5,347,692 | * | 9/1994 | Ebata | 24/130 |
| 5,416,951 | * | 5/1995 | Keyaki et al. | 24/429 |
| 5,469,583 | * | 11/1995 | Akeley et al. | 2/421 |

FOREIGN PATENT DOCUMENTS

| | | | | |
|---|---|---|---|---|
| 0800217 | * | 12/1968 | (CA) | 24/134 R |
| 1247781 | * | 9/1971 | (GB) | 24/134 R |
| 1164645 | * | 9/1989 | (GB) | 24/134 R |

* cited by examiner

*Primary Examiner*—Victor N. Sakran
(74) *Attorney, Agent, or Firm*—Kenyon &Kenyon

(57) ABSTRACT

A fastener for selectively clamping a zipper cord which includes a base portion having a U-shaped channel therein and a movable locking arm selectively movable from an unlocked to a locked position. The locking arm is provided with a securing protrusion for securing a zipper cord disposed in the U-shaped channel and is sized and adapted so that the locking arm is urged or biased into the locked position as the zipper cord is pulled away from the base portion.

10 Claims, 5 Drawing Sheets

ZIPPER PULL CORD FASTENER

FIELD OF INVENTION

The present invention relates generally to a device for selectively securing a cord, rope, or other elongated flexible article and more particularly to a device for selectively securing and attaching a zipper pull.

BACKGROUND OF THE INVENTION

Various clamps are known in the prior art. For instance, U.S. Pat. No. 4,368,999 discloses a coupling for connecting the end part of a flexible element such as a cable or wire. The part is formed from two separate portions. The first portion is a cage receiving the flexible element and includes laterally at least one extending flexible strip normally projecting outside of the cage. A second portion is a slider being adapted to be slid over the cage in order to urge the strip inwardly so that a portion of the strip is embedded in the flexible element.

U.S. Pat. No. 5,283,930 discloses a clasp for a folded cord includes two portions which make to form a clasp body thereby capturing the folded cord therebetween. The portions include gripping teeth for defining a tortious path for the cord.

U.S. Pat. No. 4,688,337 discloses a two piece buckle type fastener including a receptacle and clasp. The clasp includes a base, a substantially rigid stem protruding from the base, a pair of resilient arms extending from the stem, and locking means on the arms. The receptacle includes a body that defines a cavity adapted to receive and to cooperatively engage the pair of resilient arms within the cavity. The fastener also includes means for disengaging the locking means so that the receptacle sand clasp can be separated.

U.S. Pat. No. 5,469,583 discloses a buckle device for temporarily fastening at least two straps together having a base unit and an arm rotatably mounted on the base unit. The arm has a strap engagement part with a protuberance thereon, the arm being movable from a locked position to an open position, the arm in its locked position forcing at least two straps in engagement with each other between the engagement part and the base unit. The arm is movable to an open position wherein the engagement part is rotated away from the straps so that the straps are free to move relative to each other and relative to the device.

U.S. Pat. No. Des. 355,147 discloses a zipper pull.

One shortcoming of these prior art securing devices is that they may be complicated and, thus, expensive to manufacture.

Another shortcoming of these prior art devices is that it may be difficult or time consuming to introduce and remove the cord or rope from the securing device.

Yet another shortcoming of prior art devices is that the portions securing the cord or rope may tend to open or loosen in response to the cord or rope being pulled in a direction away from the housing.

SUMMARY OF THE INVENTION

It is an object of this invention to provide an apparatus for easily and quickly securing a rope or cord to a zipper that is simple and inexpensive to manufacture.

It is another object of this invention to provide an apparatus for securing a rope or cord to a zipper that urges the locking portions into a locking position in response to a pull or tug or other tension applied to the rope or cord.

It is another object of this invention to provide a device for selectively securing an elongated flexible article to a zipper, comprising: a device for selectively securing a zipper cord, comprising: a base portion having a base portion wall, a first side wall projecting from the base portion wall and a second side wall projecting from the base portion wall, the walls defining a U-shaped channel; and a locking arm rotatably mounted on the base portion, the locking arm provided with a locking arm engagement protrusion, the locking arm rotatably movable from an unlocked first position which provides a first clearance between the base portion wall and the locking arm engagement protrusion, the first clearance sufficient for the zipper cord to be introduced into and withdrawn from the U-shaped channel, the locking arm rotatable to a locked second position providing a second clearance between the base portion wall and the locking arm engagement protrusion, the second clearance smaller than the first clearance and sized so that when the locking arm is in the second position, the locking arm engagement protrusion impinges on the zipper cord in an amount sufficient to secure the zipper cord in the U-shaped channel, the locking arm engagement protrusion sized and disposed so that when the zipper cord is pulled in a direction away from the base portion, the locking arm is urged toward the second position; means for selectively moving the locking arm from the first position to the second position; and means for locking the locking arm in the second position.

It is yet another object of this invention to provide a device for selectively securing a zipper cord, comprising a base portion having a base portion wall, a first side wall projecting from the base portion wall and a second side wall projecting from the base portion wall, the walls defining a U-shaped channel; and a locking arm rotatably mounted on the base portion, the locking arm provided with a flexible tooth-like member, the locking arm rotatably movable from an unlocked first position which provides a first clearance between the base portion wall and the flexible tooth-like member, the first clearance sufficient for the zipper cord to be introduced into and withdrawn from the U-shaped channel, the locking arm rotatable to a locked second position providing a second clearance between the base portion wall and the flexible tooth-like member, the second clearance smaller than the first clearance and sized so that when the locking arm is in the second position, the flexible tooth-like member, impinges on the zipper cord in an amount sufficient to secure the zipper cord in said U-shaped channel, the flexible tooth-like member sized and adapted to accommodate and secure cords of varying diameters when the locking arm is disposed in the second position, the flexible tooth-like member sized and disposed so that when the zipper cord is pulled in a direction away from the base portion, the rotatable arm is urged toward the second position; means for selectively moving the locking arm from the first position to the second position; and means for locking the locking arm in the second position

DETAILED DESCRIPTION OF THE PREFERRED EMBODIMENTS

Figure 1:
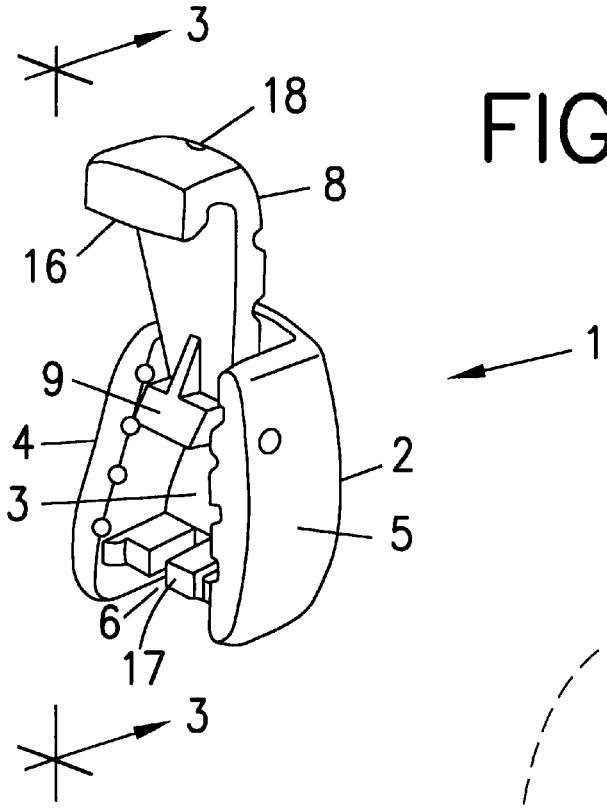
FIG. 1 shows a locking arm and base portion constructed in accordance with the invention with the locking arm in a first or unlocked position.
Figure 2:
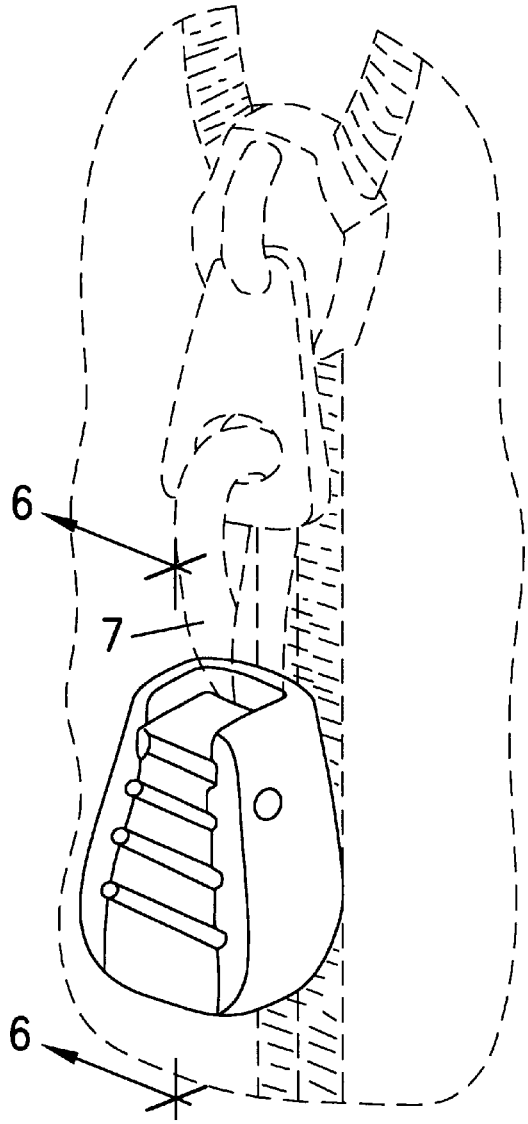
FIG. 2 is the device of FIG. 1 with the locking arm disposed in the second or locked position.
Figure 3:
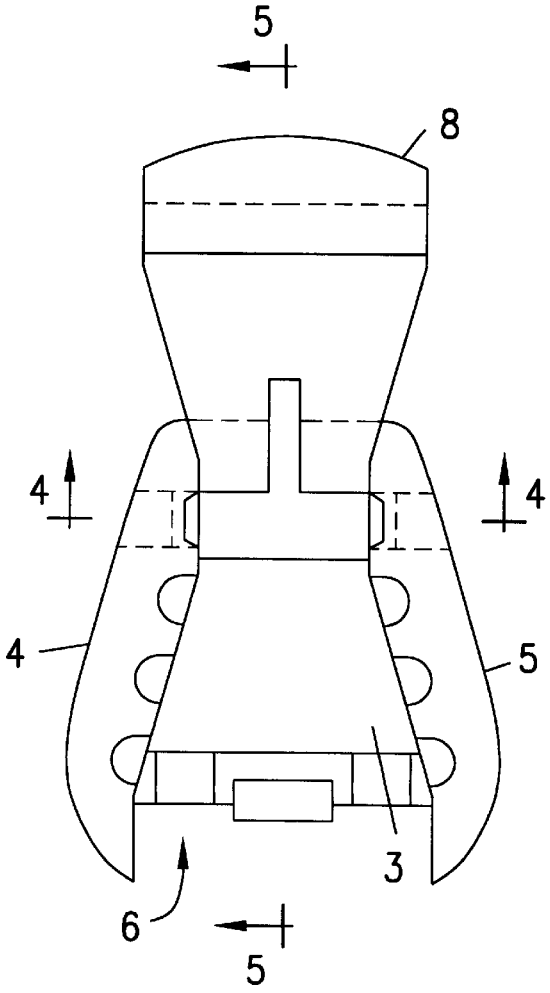
FIG. 3 is a side view of the device shown in FIG. 1.

FIG. 1 shows a zipper cord fastener 1 constructed in accordance with the present invention and shows a base portion 2 having a base portion wall 3, a first side wall 4 projecting from the base portion wall 3, and a second side wall 5 projecting from the base portion wall 3, defining a U-shaped channel 6. The U-shaped channel 6 is sized to receive an elongated flexible article such as a zipper cord 7, (shown in FIGS. 2, 5 and 6).

Figure 4:
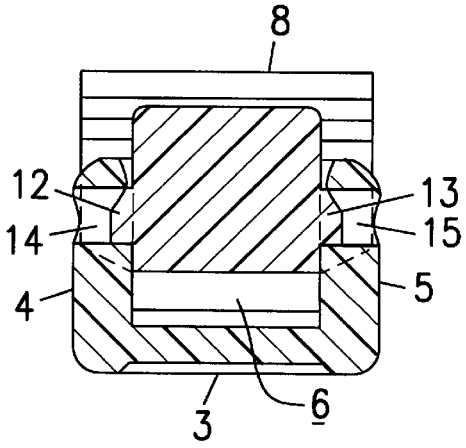
FIG. 4 is a cross-sectional end view taken along line 4—4 of FIG. 3.
Figure 5:
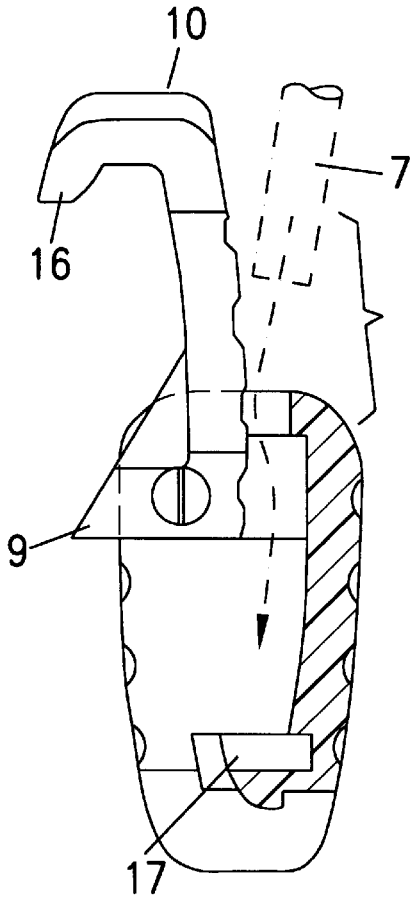
FIG. 5 is a cross-sectional side view taken along line 5—5 of FIG. 3 with the locking arm in the first or unlocked position.
Figure 6:
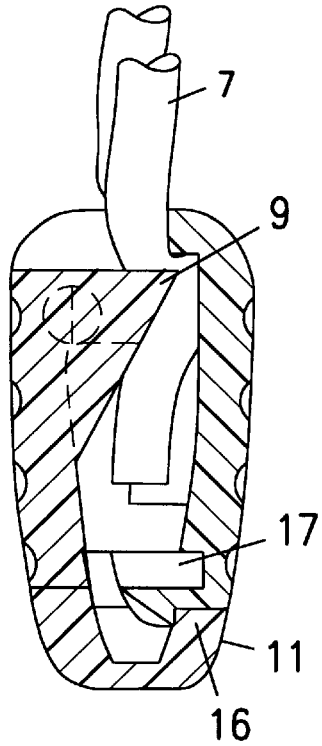
FIG. 6 shows the device shown in FIG. 5 with the locking arm moved to the second or locking position.
Figure 5A:
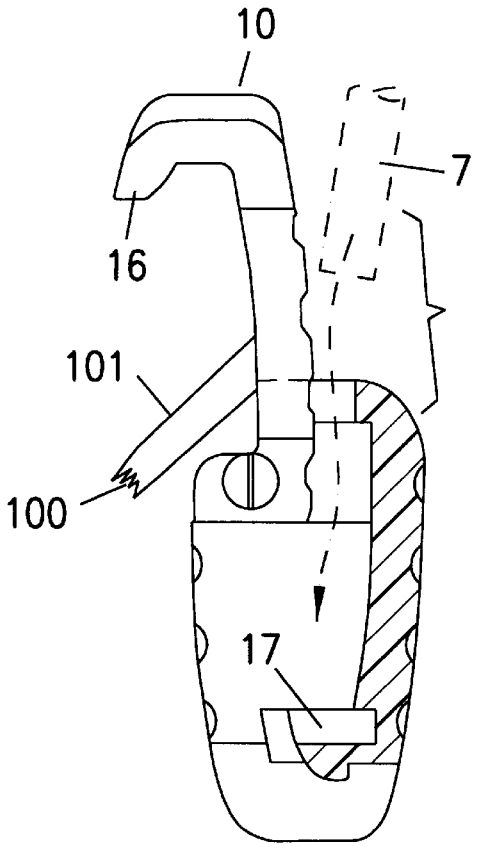
FIG. 5A shows an alternative embodiment of the invention utilizing a flexible tooth-like member.

A locking arm is 8 rotatably mounted on the base portion 2 and is provided with a locking arm engagement protrusion 9. The locking arm 8 is rotatably movable from an unlocked first position 10 as shown in FIG. 5 to a locked second position 11 as shown in FIG. 6. Means are provided for selectively rotatably moving the locking arm 8 from the first or unlocked position 10 to the second or locked position 11. In one preferred embodiment, as shown in FIG. 4, the means for moving the locking arm 8 from the first position 10 to the second position 11 comprises a pair of cylindrical protrusions 12 and 13 extending from the locking arm 8 for close fitting engagement with a similarly shaped corresponding pair of depressions or apertures 14 and 15 disposed in the side walls 4 and 5. The outward ends of protrusions 12 and 13 may be cammed, as shown in FIG. 4, to facilitate a "snap-fit" engagement of protrusions 12 and 13 with depressions 14 and 15 and, thus, facilitate assembly.

When the locking arm 8 is disposed in the first position 10 it provides a first clearance C1 between the base portion wall 3 and the locking arm engagement protrusion 9. This first clearance C1 is sufficient to permit a zipper cord 7 or other elongated flexible article to be introduced into and withdrawn from the U-shaped channel 6. When the locking arm 8 is rotated and moved to the second or locking position 11 it provides a second clearance C2 between base portion wall 3 and the locking arm engagement protrusion 9. The second clearance C2 is smaller than the first clearance C1 which causes the locking arm engagement protrusion 9 to impinge upon a zipper cord, rope or wire 7 disposed in the U-shaped channel 6 in an amount sufficient to secure the zipper cord, rope or wire 7 in the U-shaped channel 6 of the base portion 2. The locking arm engagement protrusion 9 is sized and disposed so that when the rope, zipper cord or wire 7 is pulled or tugged in a direction away from the base portion 2, the pressure applied to the locking arm engagement protrusion 9 causes the locking arm 8 to be urged toward the second or locked position 11. Thus, the harder the cord or wire 7 is pulled, the tighter it is secured within the U-shaped channel 6 of the base 2.

In an alternative embodiment, shown in FIG. 5B, the locking arm 8 is provided with a flexible tooth-like member 101 that is sufficiently flexible so as to accommodate cords of varying diameters and is sufficiently rigid to secure cords of varying diameters in the channel 6 when the locking arm is in the second or locked position. The flexible tooth-like member 101 may be provided with serrations 100.

In a preferred embodiment, the device 1 is provided with a locking means for selectively locking the locking arm in the second or locked position 11. A variety of locking means well known to those skilled in the art as suitable for this purpose may be utilized, however, in a preferred embodiment a male female interlock is used. In one preferred embodiment, shown in FIGS. 5 and 6, the locking arm 8 is provided with a first interlock protrusion 16 sized and adapted to selectively engage and disengage a second interlock protrusion 17 protruding from the base portion wall 3. In an especially preferred embodiment, the locking arm 8 is provided with a fingernail tab 18 for grasping the locking arm 8, thus, facilitating the selective movement of the locking arm 8 from the second or locked position 11 to the first or unlocked position 10.

Figure 7:
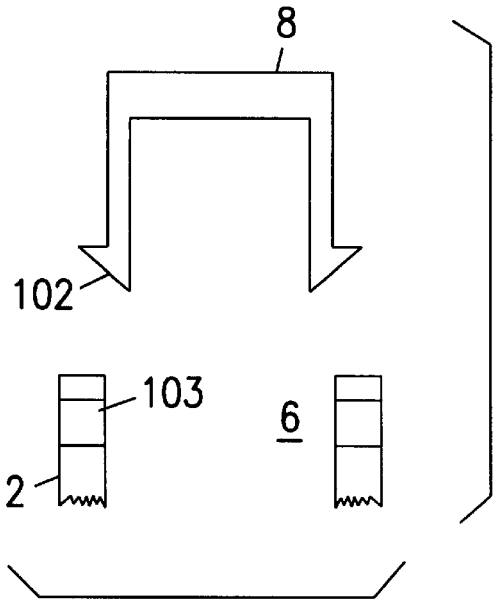
FIG. 7 shows an alternative embodiment of a locking means utilized in accordance with the invention.
Figure 7A:
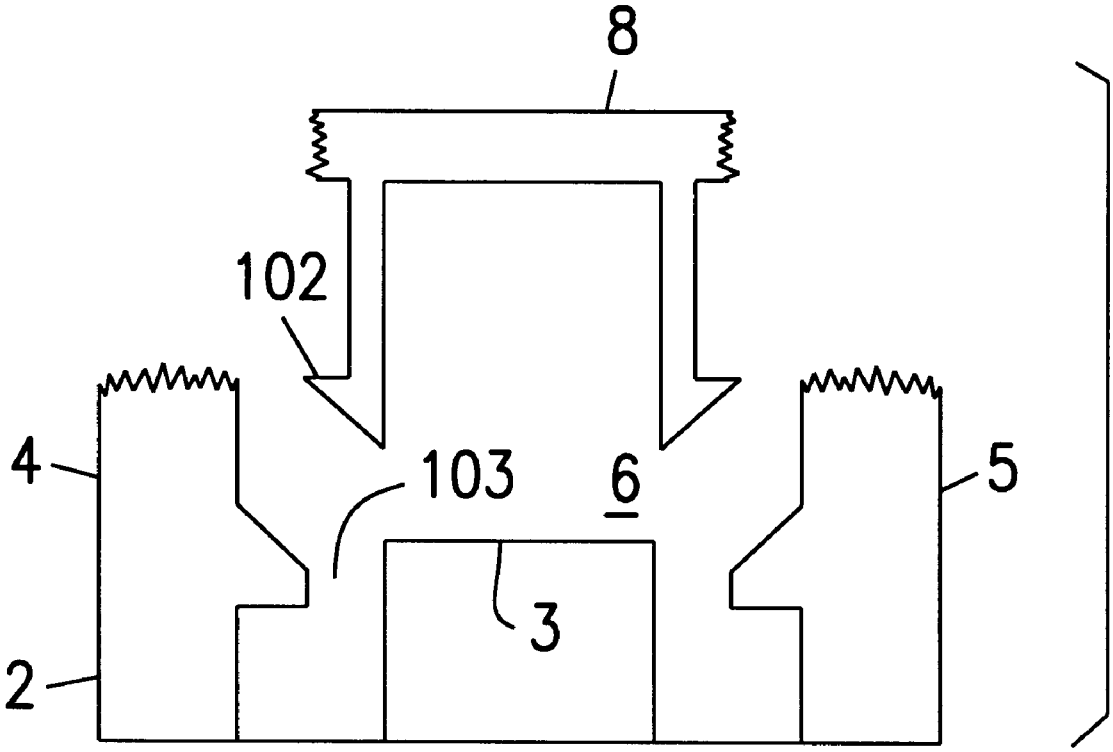
FIG. 7A shows an alternative embodiment of a locking means utilized in accordance with the invention.

In yet another preferred embodiment of a locking means, shown in FIG. 7, the locking means comprises at least one interlock protrusion 102 extending from the locking arm. The base is provided with at least one corresponding interlock receiving aperture 103 sized and adapted to receive and interlock with the interlock protrusion 102 when the locking arm is disposed in the second or locked position 11. The at least one corresponding receiving aperture 103 may be disposed in one or both of the first and second base portion side walls 4 and 5 as shown in FIG. 7. Alternatively, the at least one corresponding receiving aperture 103 may be disposed in the base portion wall 3 as shown in FIG. 7A.

Although the present invention has been described in specific and detailed terms with respect to the preferred embodiments as set forth above, various other embodiments of this invention including alterations in size, shape, etc., substitutions of conventional elements and other applications will be readily apparent to those with ordinary skill in the art without departing from the broader spirit and scope of the invention as set forth in the appended claims. Therefore, the specification is to be regarded in an illustrative rather than restrictive sense.

What is claimed is:

1. A device for selectively securing a zipper cord, comprising:

a) a base portion having a base portion wall, a first side wall projecting from said base portion wall and a second side wall projecting from said base portion wall, said walls defining a U-shaped channel; and b) a locking arm rotatably mounted on said base portion, said locking arm provided with a flexible tooth-like member, said locking arm rotatably movable from an unlocked first position which provides a first clearance between said base portion wall and said flexible tooth-like member, said first clearance sufficient for said zipper cord to be introduced into and withdrawn from said U-shaped channel, said locking arm rotatable to a locked second position providing a second clearance between said base portion wall and said flexible tooth-like member, said second clearance smaller than said first clearance and sized so that when said locking arm is in said second position, said flexible tooth-like member impinges on said zipper cord in an amount sufficient to secure said zipper cord in said U-shaped channel, said flexible tooth-like member sized and adapted to accomodate and secure cords of varying diameters when said locking arm is disposed in said second position, said flexible tooth-like member sized and disposed so that when said zipper cord is pulled in a direction away from said base portion, said locking arm is urged toward said second position;

c) means for selectively moving said locking arm from said first position to said second position; and d) means for locking said locking arm in said second position; wherein said means for selectively moving comprises a plurality of protrusions extending from said locking arm sized and adapted to selectively engage corresponding apertures disposed in said base portion.

2. The device of claim 1, wherein said locking means comprises an interlock protrusion extending from said locking arm sized and adapted to selectively engage and interlock with a corresponding interlock protrusion extending from said base portion wall.

3. The device of claim 1, wherein said locking means comprises at least one interlock protrusion protruding from said locking arm and at least one interlock receiving aperture disposed in said base, said interlock protrusion and said interlock receiving aperture sized and adapted to interlock when said locking arm is disposed in said second position.

4. The device of claim 3, wherein said at least one interlock receiving aperture is disposed in at least one of said first and second sidewalls of said base portion.

5. The device of claim 3, wherein said at least one interlock receiving aperture is disposed in said base portion wall of said base portion.

6. A device for selectively securing a zipper cord, comprising:

a) a base portion having a base portion wall, a first side wall projecting from said base portion wall and a second side wall projecting from said base portion wall, said walls defining a U-shaped channel; and b) a locking arm rotatably mounted on said base portion, said locking arm provided with a flexible tooth-like member, said locking arm rotatably movable from an unlocked first position which provides a first clearance between said base portion wall and said flexible tooth-like member, said first clearance sufficient for said zipper cord to be introduced into and withdrawn from said U-shaped channel, said locking arm rotatable to a locked second position providing a second clearance between said base portion wall and said flexible tooth-like member, said second clearance smaller than said first clearance and sized so that when said locking arm is in said second position, said flexible tooth-like member impinges on said zipper cord in an amount sufficient to secure said zipper cord in said U-shaped channel, said flexible tooth-like member sized and adapted to accommodate and secure cords of varying diameters when said locking arm is disposed in said second position, said flexible tooth-like member sized and disposed so that when said zipper cord is pulled in a direction away from said base portion, said locking arm is urged toward said second position;

c) means for selectively moving said locking arm from said first position to said second position; and d) means for locking said locking arm in said second position; wherein said means for selectively moving comprises a plurality of protrusions extending from said locking arm sized and adapted to selectively engage corresponding apertures disposed in said base portion.

7. The device of claim 1, wherein said plurality of protrusions are cylindrical.

8. The device of claim 7, wherein said cylindrical protrusions are provided with a cammed surface.

9. The device of claim 1, wherein said means for locking comprises a male female interlock.

10. The device of claim 1, further comprising a fingernail tab disposed on said locking arm.

* * * * *

UNITED STATES PATENT AND TRADEMARK OFFICE

CERTIFICATE OF CORRECTION

PATENT NO. : 6,209,176 B1
DATED : April 3, 2001
INVENTOR(S) : Anscher, Joseph

It is certified that error appears in the above-identified patent and that said Letters Patent is hereby corrected as shown below:

Column 1,
Line 35, change “sand” to -- and --

Column 4,
Line 60, change “accomodate” to -- accommodate --

Column 5, lines 24-35 and Column 6, lines 1-25,
Delete and insert -- 6. The device of claim 1, wherein said flexible tooth-like member is provided with serrations. --

Signed and Sealed this

Seventeenth Day of December, 2002

JAMES E. ROGAN
*Director of the United States Patent and Trademark Office*